US008770494B2

(12) United States Patent
Arzuaga

(10) Patent No.: US 8,770,494 B2
(45) Date of Patent: Jul. 8, 2014

(54) SYSTEMS AND DEVICES FOR FLUID DECOKING

(75) Inventor: Daniel O. Arzuaga, Hermosa Beach, CA (US)

(73) Assignee: Flowserve Management Company, Irving, TX (US)

( * ) Notice: Subject to any disclaimer, the term of this patent is extended or adjusted under 35 U.S.C. 154(b) by 349 days.

(21) Appl. No.: 13/217,357

(22) Filed: Aug. 25, 2011

(65) Prior Publication Data

US 2012/0199672 A1 Aug. 9, 2012

Related U.S. Application Data

(60) Provisional application No. 61/440,611, filed on Feb. 8, 2011.

(51) Int. Cl.
*C10B 33/00* (2006.01)
*A62C 31/00* (2006.01)

(52) U.S. Cl.
USPC .... 239/443; 239/446; 239/447; 239/DIG. 13; 202/241

(58) Field of Classification Search
USPC ..... 239/566, 438, 442, 447, 443, 449, 446, 239/436, 550, 581.1, 562, 563, 553, 589, 239/590, 601, DIG. 13; 299/17, 29, 81.1, 299/81.2; 175/56, 339, 393, 228, 64, 67; 202/241, 48
See application file for complete search history.

(56) References Cited

U.S. PATENT DOCUMENTS

| | | | | |
|---|---|---|---|---|
| 4,410,398 | A | 10/1983 | Chipman et al. | |
| 5,022,799 | A | 6/1991 | Torres et al. | |
| 5,816,505 | A * | 10/1998 | Tran et al. | 239/443 |
| 5,855,742 | A * | 1/1999 | Lumbroso et al. | 202/241 |
| 6,644,567 | B1 * | 11/2003 | Adams et al. | 239/566 |
| 7,578,907 | B2 * | 8/2009 | Lah | 202/242 |
| 8,066,334 | B2 | 11/2011 | Paul et al. | |
| 8,398,825 | B2 * | 3/2013 | Adams et al. | 202/241 |

FOREIGN PATENT DOCUMENTS

| | | |
|---|---|---|
| FR | 2716458 | 8/1995 |
| WO | 2007/044477 A2 | 4/2007 |

OTHER PUBLICATIONS

International Search Report, Appl. No. PCT/US2012/024104, filed Feb. 7, 2012, 13 pages.
Non-verified machine translation of FR2716458.

* cited by examiner

*Primary Examiner* — Len Tran
*Assistant Examiner* — Alexander M Valvis
(74) *Attorney, Agent, or Firm* — Dinsmore & Shohl LLP

(57) ABSTRACT

A decoking tool includes a tool body, a diverter plate, a diverter body, a plurality of flow paths and a shifting apparatus. The plurality of flow paths may include a clearing flow path, a cutting flow path and a boring flow path each having a nozzle. The nozzle that terminates the clearing flow path can be directed substantially upwards during normal operation. The shifting apparatus can be operatively coupled to the diverter plate and/or the diverter body such that upon operation of the shifting apparatus, the diverter plate and the diverter body rotate relative to one another to substantially align a selection orifice and at least one of a clearing orifice, a cutting orifice and a boring orifice to establish fluid communication between the fluid inlet and the respective nozzle.

18 Claims, 9 Drawing Sheets

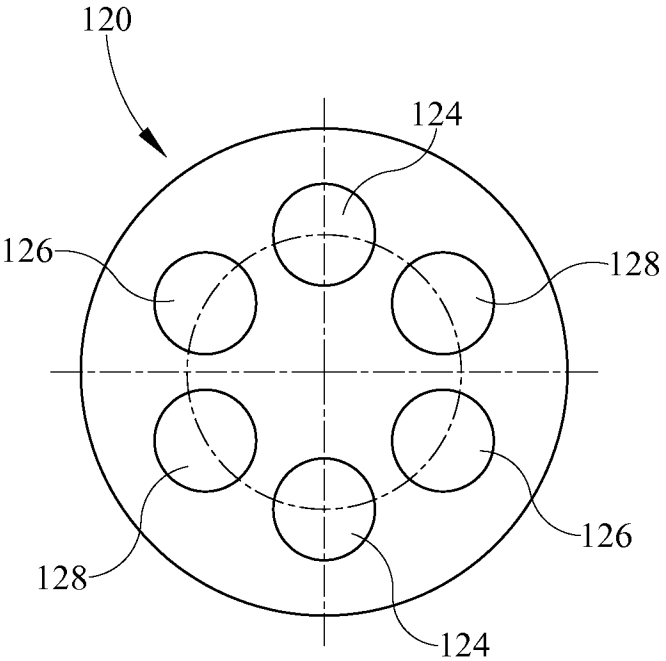
FIG. 3
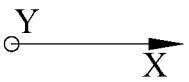
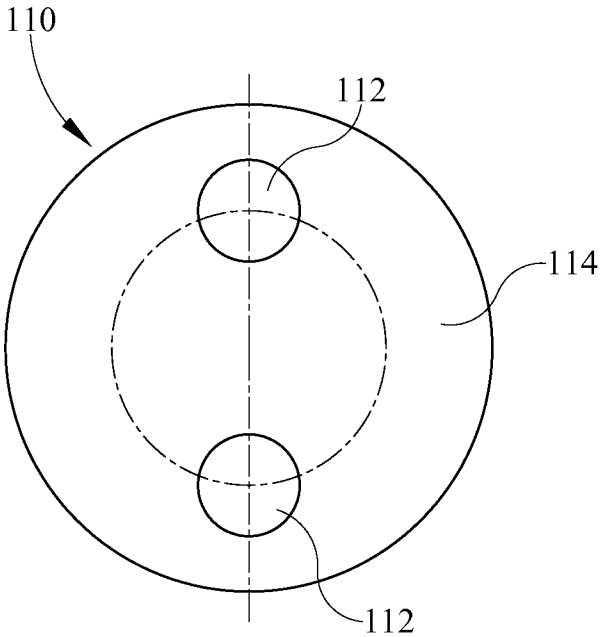
FIG. 2
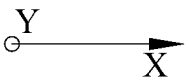

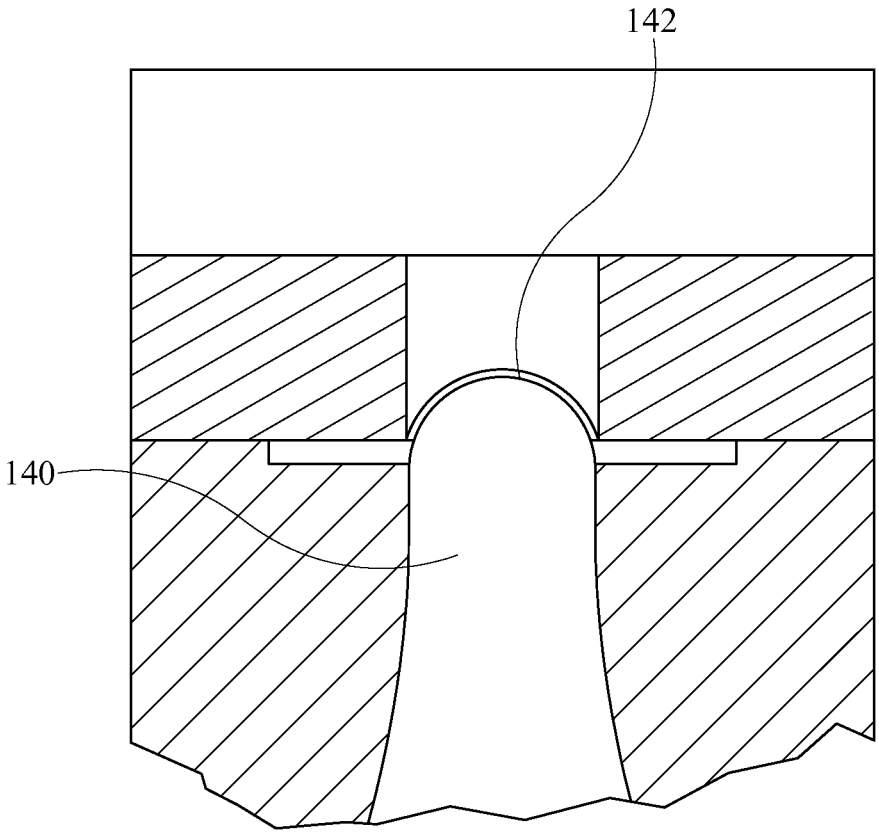
FIG. 4A
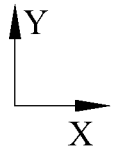

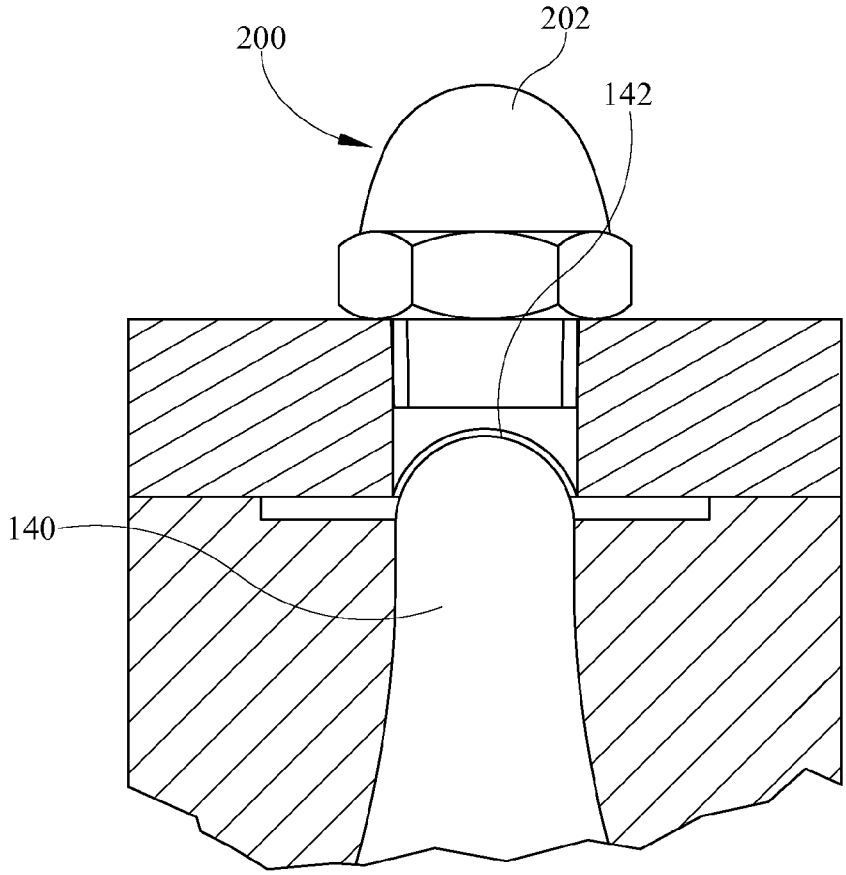
FIG. 4B
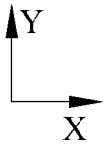

SYSTEMS AND DEVICES FOR FLUID DECOKING

CROSS-REFERENCE TO RELATED APPLICATIONS

This application claims the benefit of U.S. Provisional Application No. 61/440,611, filed Feb. 8, 2011, entitled "SYSTEMS & DEVICES FOR FLUID DECOKING." The entire content of said application is hereby incorporated by reference.

TECHNICAL FIELD

The embodiments described herein generally relate to systems, methods and devices for removing coke from containers such as coking drums used in oil refining.

BACKGROUND

During the distillation of heavy oils to remove valuable lighter distillates, some of the lightest constituents are removed in a fractionation vessel. For example, in a delayed coker operation of a petroleum refinery, heavy hydrocarbon (oil) is heated to about 900° F.—about 1000° F. (about 482° C. to about 538° C.) in large fired heaters and transferred to cylindrical vessels known as coke drums which can be as large as about 30 feet (about 9.1 meters) in diameter and about 140 feet (about 42.7 meters) in height. The heated oil releases its hydrocarbon vapors for processing into useful products, leaving behind solid petroleum coke which may accumulate in the drum and may reduce the efficacy of the drum for further hydrocarbon processing. The accumulated coke may be broken up and removed from the drum in the decoking cycle of the coker operation in order to prepare the coke drum for further hydrocarbon processing. Decoking may be accomplished, for example, by using high-pressure water directed through nozzles of a decoking (or coke cutting) tool.

Since flows of about 1000 gallons per minute (gpm) (about 3.79 cubic meters per minute) at about 3000 to about 6000 pounds per square inch (psi) (about 20, 684 kPa to about 41,368 kPa) can be used for such operations, it is neither practical nor desirable to open drilling and cutting nozzles at the same time. Thus diverter valves may direct the flow to the selected nozzles as required for the decoking operation. There are two commonly used diverter valve designs, both of which are complex, require numerous components, and require a very high level of precision in their manufacture in order to function. One such valve is a reciprocatable sleeve type valve having radial ports which selectively align with corresponding ports in the valve body to direct flow to either the drilling or cutting nozzles. The other is a rotatable sleeve, again having ports for selective alignment with corresponding ports of the valve body.

Many decoking tools have downward-oriented drilling or boring nozzles and sideward-oriented cutting nozzles. Decoking can be accomplished using the nozzles in two phases. First, a pilot hole, about 3 feet (about 0.9 meters) to about 4 feet (about 1.2 meters) in diameter, is cut, or drilled, downward from the top of the drum through the coke bed using the boring nozzles of the decoking tool. Then, the decoking tool is raised to the top of the vessel where either the whole tool or the cutting mode is engaged to use the cutting nozzles, and the tool, rotated and moved vertically downward in the pilot hole, cuts the balance of the coke and flushes it out the open bottom of the drum. In some aggressive operations, to reduce decoking time, the tool is changed to the cutting nozzles at the bottom of the drum, and the tool, rotated and moved vertically upward in the pilot hole, cuts the balance of the coke and flushes it out the open bottom of the drum. In this way, the raising step is skipped.

Removal of the tool from the drum to either change it out or to change its cutting mode is a cumbersome and time-consuming operation which, considering the cost and limited number of coke vessels, can significantly impact the production capacity of a refinery. Thus, there has been a continuing interest in combination decoking tools which are capable of remotely activated cutting mode shifting. For a long time, all attempts at providing such tools have failed because of mechanical jamming of mode shifting mechanisms caused by suspended coke debris in the cutting fluid. The debris is the result of recycling of the cutting fluid. Since all previous designs included some form of shuttle valve driven by through-flowing cutting fluid, all were subject to jamming due to debris carried in the cutting fluid which settled or was filtered out of the fluid and gathered between sliding surfaces of valve members. Thus, the very fluid needed to operate the shifting mechanism was the ultimate cause of the failure of the mechanism. In addition, these designs accomplished cutting mode shifting by application of full cutting fluid pressure, thereby increasing friction forces and exacerbating the jamming tendency of the debris-laden shuttle devices.

To overcome difficulties associated with the shuttle-based valve designs, the assignee of the present invention developed a relatively trouble-free, manually shiftable, combination decoking tool; such device is described in U.S. Pat. No. 5,816,505, the entirety of which is incorporated herein by reference. Additionally, a remotely operated cutting mode shifting apparatus for a decoking tool was developed and was described in U.S. Pat. No. 6,644,567 which is commonly owned herewith and is incorporated herein by reference.

Even with properly-functioning decoking tools, a coke bed may collapse during the decoking operation, particularly during aggressive operation, and trap the decoking tool within the drum. Once entrapped, the decoking tool is relatively difficult to free. Decoking tool freeing operations may take between about 4 hours to about 12 hours to remove (e.g., by flooding the drum to remove coke from the top of the drum and away from the decoking tool).

Accordingly, a need exists for alternative to systems and devices for fluid decoking.

SUMMARY

In one embodiment, a decoking tool may include a tool body, a diverter plate, a diverter body, a plurality of flow paths and a shifting apparatus. The tool body may include a fluid inlet for receiving a pressurized fluid. The diverter plate can be in fluid communication with the fluid inlet and can define at least one selection orifice disposed therethrough. The diverter body can be in fluid communication with the diverter plate through the at least one selection orifice. The diverter body can define therein at least one clearing orifice, at least one cutting orifice and at least one boring orifice. The plurality of flow paths may include a clearing flow path, a cutting flow path and a boring flow path each of which terminates in a nozzle that is placed in selective fluid communication with the pressurized fluid through the diverter plate and the respective orifice in the diverter body. The nozzle that terminates the clearing flow path can be directed substantially upwards during normal operation of the decoking tool. The shifting apparatus can be operatively coupled to at least one of the diverter plate and the diverter body such that upon operation of the shifting apparatus, the diverter plate and the diverter body rotate relative to one another to substantially align the at least one selection orifice and at least one of the at least one clearing orifice, the at least one cutting orifice and the at least one boring orifice in order to establish fluid communication between the fluid inlet and the respective nozzle.

In another embodiment, a decoking system may include a labyrinth guide plate and a decoking tool. The labyrinth guide plate may include a first plate and a second plate. The first plate may include a first fluid blocking potion and a first vapor release orifice. The second plate may include a second fluid blocking potion and a second vapor release orifice. The first plate and the second plate can be offset by a vapor release gap. The first vapor release orifice can be skewed with respect to the second vapor release orifice. The decoking tool can operate within a coke drum and below the labyrinth guide plate. The decoking tool may include a tool body, a diverter plate, a diverter body, a plurality of flow paths and a shifting apparatus. The tool body may include a fluid inlet for receiving a pressurized fluid. The diverter plate can be in fluid communication with the fluid inlet, and can define at least one selection orifice disposed therethrough. The diverter body can be in fluid communication with the diverter plate through the at least one selection orifice. The diverter body can define therein at least one clearing orifice, at least one cutting orifice and at least one boring orifice. The plurality of flow paths may include a clearing flow path, a cutting flow path and a boring flow path each of which terminates in a nozzle that is placed in selective fluid communication with the pressurized fluid through the diverter plate and the respective orifice in the diverter body. The nozzle that terminates the clearing flow path can be directed substantially upwards during normal operation of the decoking tool. The shifting apparatus can be operatively coupled to at least one of the diverter plate and the diverter body such that upon operation of the shifting apparatus, the diverter plate and the diverter body rotate relative to one another to substantially align the at least one selection orifice and at least one of the at least one clearing the orifice, the at least one cutting orifice and the at least one boring orifice in order to establish fluid communication between the fluid inlet and the respective nozzle.

In yet another embodiment, a decoking tool may include a tool body, a diverter plate, a diverter body, a plurality of flow paths, a pressure regulating nozzle, a burst disc, and a shifting apparatus. The tool body may include a fluid inlet for receiving a pressurized fluid. The diverter plate can be in fluid communication with the fluid inlet and define at least one selection orifice disposed therethrough. The diverter body can be in fluid communication with the diverter plate through the at least one selection orifice. The diverter body can define therein at least one clearing orifice, at least one cutting orifice and at least one boring orifice. The plurality of flow paths may include a clearing flow path, a cutting flow path and a boring flow path each of which terminates in a nozzle that can be placed in selective fluid communication with the pressurized fluid through the diverter plate and the respective orifice in the diverter body. The nozzle that terminates the clearing flow path can be directed substantially upwards during normal operation of the decoking tool. The pressure regulating nozzle can be in fluid communication with the clearing flow path. The burst disc can be coupled to the nozzle that terminates the clearing flow path and may block the nozzle that terminates the clearing flow path. The shifting apparatus can be operatively coupled to at least one of the diverter plate and the diverter body such that upon operation of the shifting apparatus, the diverter plate and the diverter body rotate relative to one another to substantially align the at least one selection orifice and at least one of the at least one clearing orifice, the at least one cutting orifice and the at least one boring orifice in order to establish fluid communication between the fluid inlet and the respective nozzle. When the at least one clearing orifice of the diverter body is aligned with the at least one selection orifice of the diverter plate, the pressurized fluid can be received by the fluid inlet and a pressure of the pressurized fluid can be greater than or equal to a shift arming pressure and less than a cutting pressure, and the nozzle that terminates the clearing flow path can be deactivated by the burst disc. When the at least one clearing orifice of the diverter body is aligned with the at least one selection orifice of the diverter plate, the pressurized fluid can be received by the fluid inlet and the pressure of the pressurized fluid can be greater than or equal to the cutting pressure, and the nozzle that terminates the clearing flow path can be activated after the burst disc ruptures.

These and additional features provided by the embodiments described herein will be more fully understood in view of the following detailed description, in conjunction with the drawings

BRIEF DESCRIPTION OF THE DRAWINGS

The embodiments set forth in the drawings are illustrative in nature and not intended to limit the claimed embodiments. The following detailed description of the illustrative embodiments can be understood when read in conjunction with the following drawings, where like structure is indicated with like reference numerals and in which:

FIG. 2 schematically depicts a rotatable diverter plate according to one or more embodiments shown and described herein;

FIG. 3 schematically depicts a diverter body according to one or more embodiments shown and described herein;

FIG. 4A schematically depicts a cross-sectional view of a detail of a self-clearing nozzle according to one or more embodiments shown and described herein;

FIG. 4B schematically depicts a cross-sectional view of a self-clearing nozzle according to one or more embodiments shown and described herein;

DETAILED DESCRIPTION

Figure 1:
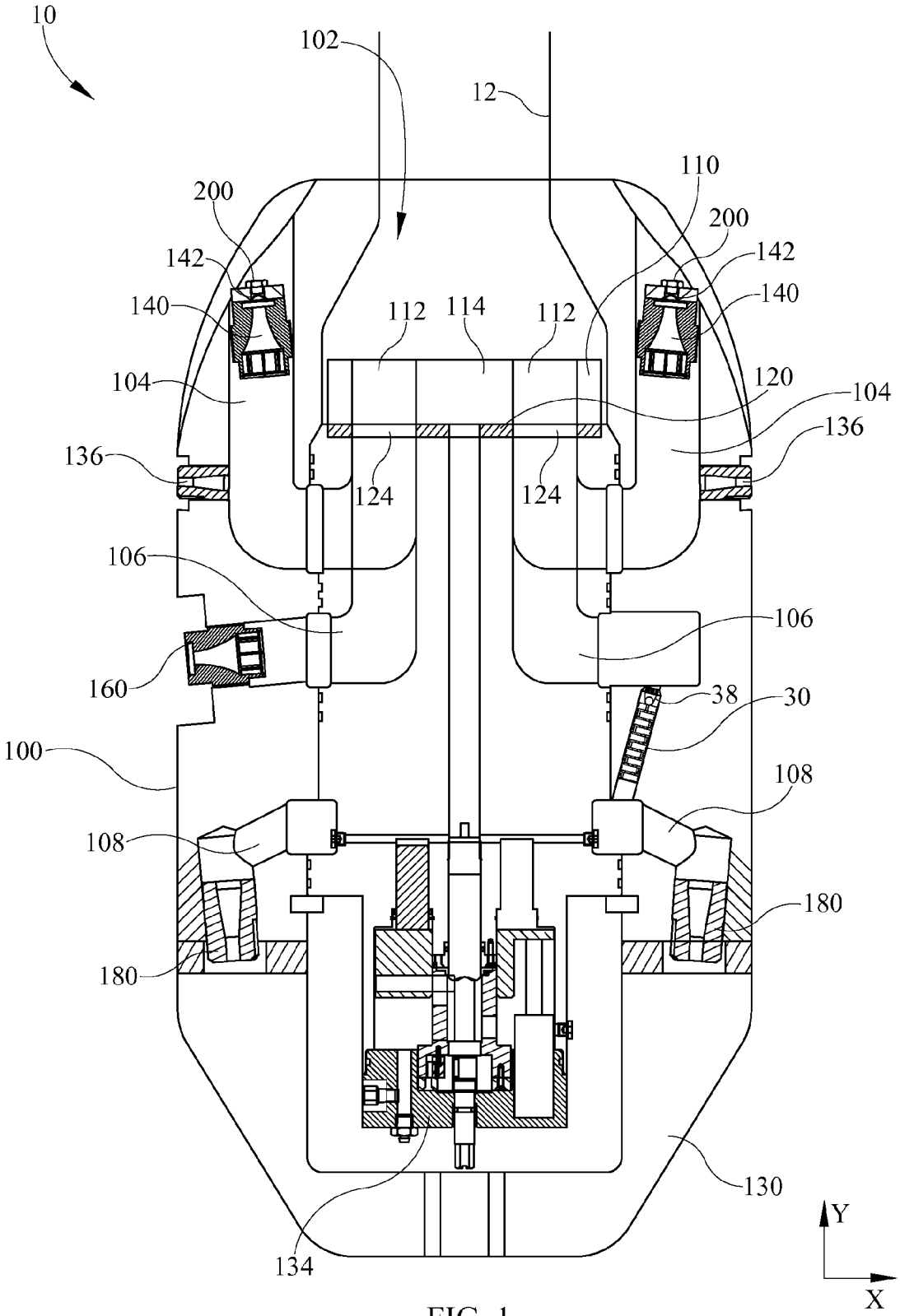
FIG. 1 schematically depicts a cross-sectional view of a decoking tool according to one or more embodiments shown and described herein.

FIG. 1 generally depicts one embodiment of a decoking tool 10. The decoking tool 10 generally comprises a tool body 100 for receiving and directing a pressurized fluid, a shifting apparatus 134, rotatable diverter plate 110, a diverter body 120 and self-clearing nozzles 140. Various embodiments of the decoking tool 10 and systems for fluid decoking are described in more detail herein. The tool body 100 may be a substantially cylindrically shaped housing that is relatively slim with respect to an internal diameter of a coking drum. Accordingly, the tool body 100 is generally shaped such that the decoking tool 10 can be placed into a coking drum without causing damage to either the tool body 100 or the coking drum. The tool body 100 may be formed through a variety of known manufacturing processes such as, for example, casting and/or machining.

The tool body 100 may comprise a fluid inlet 102 for receiving a pressurized fluid such as water for coke removal and one or more flow paths for directing the fluid to one or more nozzles. In one embodiment, the tool body 100 may comprise clearing flow paths 104, cutting flow paths 106, and boring flow paths 108, each of which are conduits traveling through the tool body 100 and are capable of delivering about 1,000 gpm (about 3.79 cubic meters per minute) of water at about 3,000 to about 6,000 psi (about 20, 684 kPa to about 41,368 kPa).

Referring now to FIG. 2, the decoking tool 10 further comprises a rotatable diverter plate 110 that rotates and allows pressurized fluid received by the tool body 100 to be selectively directed to one of a desired flow path 104, 106 or 108 for the pressurized fluid to enter. As shown, each of the flow paths 104, 106 and 108 may be made up of one or more individual flow paths; in the present context, the term "flow path" is meant to include both single path and multiple path variants. The rotatable diverter plate 110 comprises one or more selection orifices 112 and a blocking portion 114. The selection orifices 112 extend through the rotatable diverter plate 110. The blocking portion 114 is generally a rigid portion of the rotatable diverter plate 110 that is configured to force the pressurized fluid to flow through the selection orifices 112. It is noted that, while the rotatable diverter plate 110 is depicted in FIG. 2 as having a substantially circular cross section, the rotatable diverter plate 110 may have any cross sectional shape suitable to cooperate with the fluid inlet 102 of the tool body 100 and the diverter body 120. It is further noted that, while the selection orifices 112 are depicted in FIG. 2 as having a substantially circular cross section, selection orifices 112 may have any cross sectional shape suitable to fluidly communicate with the orifices of the diverter body 120.

Referring collectively to FIGS. 1 and 3, the decoking tool 10 further comprises a diverter body 120 that is configured to fluidly communicate pressurized fluid from the rotatable diverter plate 110 into a desired flow path of the tool body 100. For example, when the tool body 100 comprises clearing flow paths 104, cutting flow paths 106, and boring flow paths 108, the diverter body 120 comprises clearing orifices 124, cutting orifices 126, and boring orifices 128. It is noted that, while the diverter body 120 is depicted in FIG. 3 as having a substantially circular cross section, the diverter body 120 may have any cross sectional shape suitable to cooperate with the rotatable diverter plate 110. Furthermore it is noted that either of the a rotatable diverter plate 110 and the diverter body 120 may be fixed as the other rotates, such that the rotatable diverter plate 110 and the diverter body 120 rotate with respect to one another.

Referring collectively to FIGS. 2 and 3, the number of clearing orifices 124 in the diverter body 120 may be equal to the number of selection orifices 112 of the rotatable diverter plate 110. The number of cutting orifices 126 in the diverter body 120 may be equal to the number of selection orifices 112 of the rotatable diverter plate 110. The number of boring orifices 128 in the diverter body 120 may be equal to the number of selection orifices 112 of the rotatable diverter plate 110. Moreover, each of the clearing orifices 124, cutting orifices 126, and boring orifices 128 of the diverter body 120 may be selectively aligned with the selection orifices 112 of the rotatable diverter plate 110 (i.e., by rotation, where it will be appreciated by those skilled in the art that a configuration where the diverter body 120 is made to rotate rather than, or in conjunction with, rotatable diverter plate 110 are also within the scope of the present invention). In a first position, the clearing orifices 124 of the diverter body 120 may be aligned with the selection orifices 112 of the rotatable diverter plate 110 and the cutting orifices 126 and boring orifices 128 may be aligned with the blocking portion 114 of the rotatable diverter plate 110. In a second position, the cutting orifices 126 of the diverter body 120 may be aligned with the selection orifices 112 of the rotatable diverter plate 110 and the clearing orifices 124 and boring orifices 128 of the diverter body 120 may be aligned with the blocking portion 114 of the rotatable diverter plate 110. In a third position, the boring orifices 128 of the diverter body 120 may be aligned with the selection orifices 112 of the rotatable diverter plate 110 and the clearing orifices 124 and the cutting orifices 126 of the diverter body 120 may be aligned with the blocking portion 114 of the rotatable diverter plate 110.

Referring again to FIG. 1, the decoking tool 10 further comprises a shifting apparatus 134 that is operatively coupled to the rotatable diverter plate 110 to direct pressurized fluid into a desired flow path of the tool body 100. The shifting apparatus 134 may utilize pressurized fluid disposed within the tool body 100 to rotate the rotatable diverter plate 110 to align the selection orifices 112 and the blocking portion 114 with the appropriate orifices of the diverter body 120. In one embodiment, the shifting apparatus 134 is controlled only with pressurized water (i.e., the decoking tool 10 has no electronics within the tool body 100). The shifting apparatus 134 may be armed, i.e., supplied with sufficient energy to rotate the rotatable diverter plate 110, when the pressure of the pressurized fluid is greater than or equal to the shift arming pressure. Once armed, the shifting apparatus 134 may automatically rotate the rotatable diverter plate 110 and align the selection orifices 112 of the rotatable diverter plate 110 to the next orifice in sequence of the diverter body 120, by reducing the pressure of the pressurized fluid supplied to the decoking tool 10. A suitable shifting apparatus is disclosed in commonly assigned, co-pending U.S. Ser. No. 12/772,410, entitled "REMOTELY-OPERATED MODE SHIFTING APPARATUS FOR A COMBINATION FLUID JET DECOKING TOOL, AND A TOOL INCORPORATING SAME", filed on May 3, 2010, as well as commonly assigned U.S. Pat. No. 6,644,567, the pertinent portions of both of which are hereby incorporated by reference.

Figure 7A:
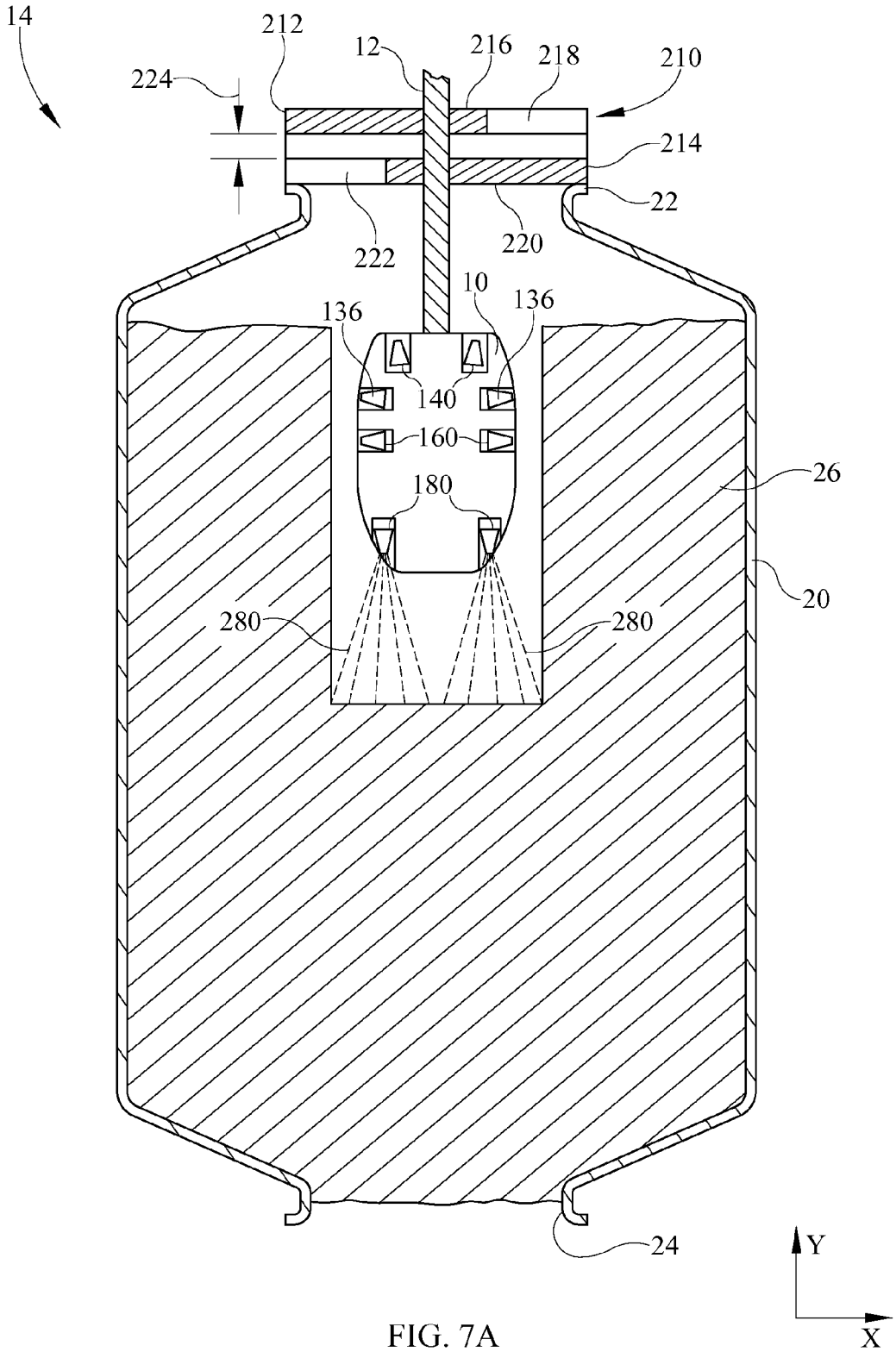
FIG. 7A schematically depicts a decoking system during a boring mode of operation according to one or more embodiments shown and described herein.
Figure 7B:
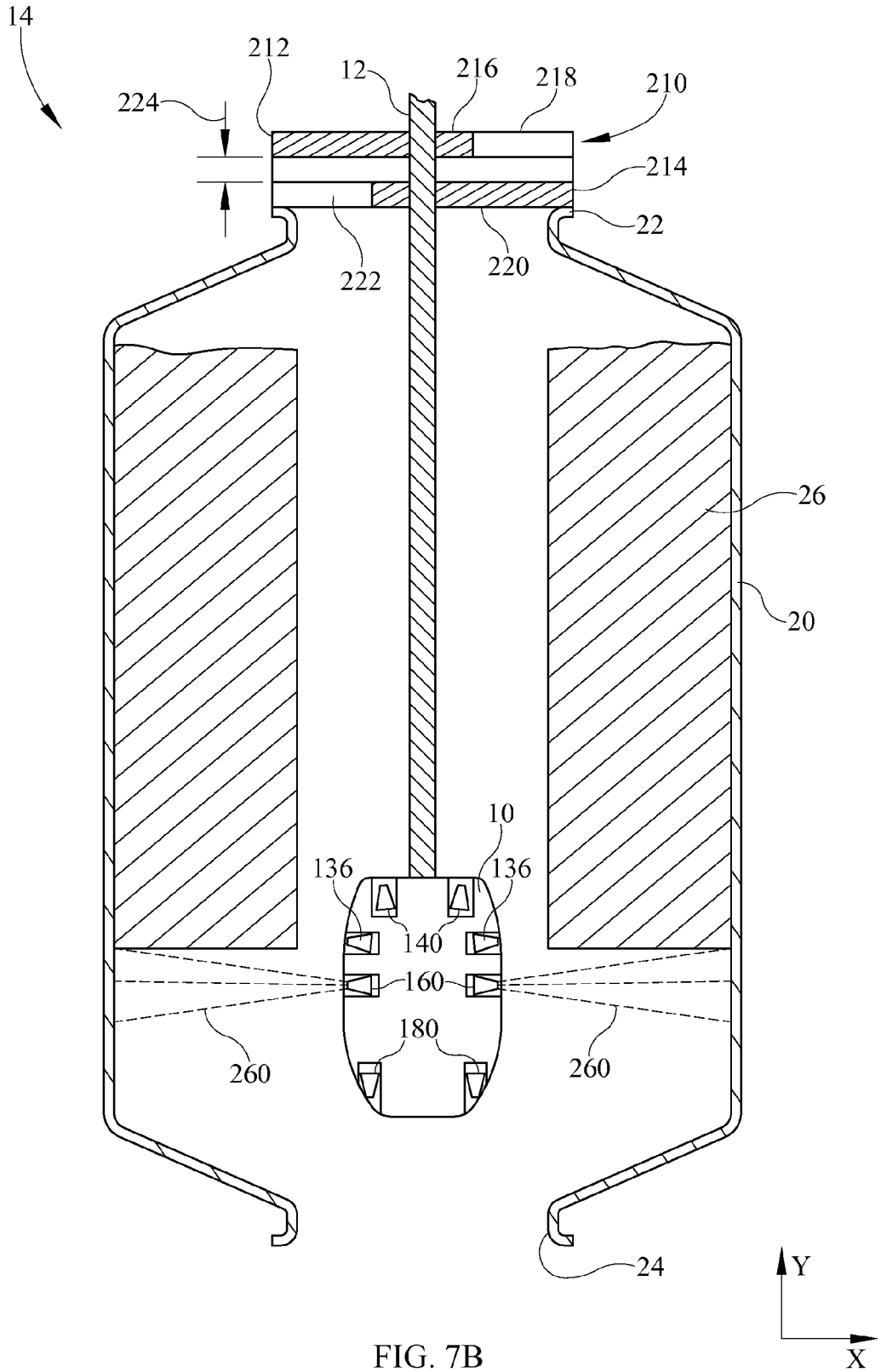
FIG. 7B schematically depicts the decoking system of FIG. 7A during a cutting mode of operation according to one or more embodiments shown and described herein.
Figure 7C:
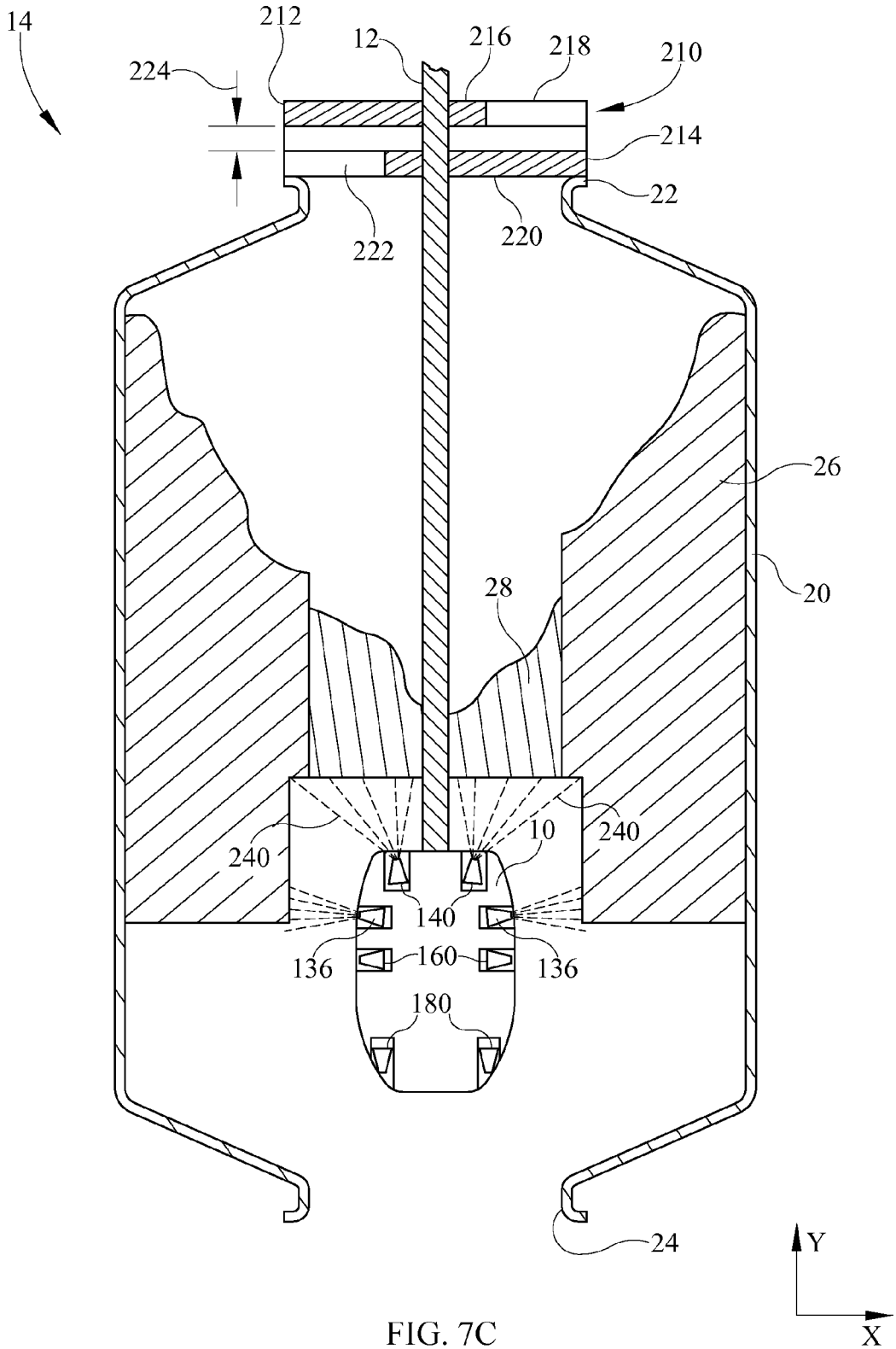
FIG. 7C schematically depicts the decoking system of FIG. 7A during a clearing mode of operation according to one or more embodiments shown and described herein.

Referring collectively to FIGS. 1 and 7C, the decoking tool 10 further comprises self-clearing nozzles 140 for extricating the decoking tool 10 from a collapse 28 of coke 26 that is contained within coke drum 20. As shown with particularity in FIG. 1, clearing nozzles 140 and their attendant flow paths 104 are configured such that they act independently of the cutting and boring nozzles 160, 180. The self-clearing nozzles 140 are directed substantially upwards (depicted as the positive Y-direction along the Y-axis in FIG. 1) during normal operation and placement of the decoking tool 10 within a coke drum. For example, the self-clearing nozzles 140 may be directed substantially upwards such that they are aligned within about 30° (about 0.52 radians) of the Y-direction such as, for example, within about 15° (about 0.26 radians) of the Y-direction. When supplied with pressurized fluid, the self-clearing nozzles 140 may direct a diffuse jet of fluid upwards and the pressure regulating nozzles 136 may direct a jet of fluid sideways to remove coke that has collapsed on the decoking tool 10. The decoking tool 10 can be positioned to avoid directing a pressurized fluid jet within the radial range of the drum opening at the higher tool operating positions. Accordingly, the self-clearing nozzles 140 may be designed to be effective in short range, while minimizing water jet pressure at longer distances. In one embodiment, the self-clearing nozzles 140, when supplied with pressurized water at the cutting pressure, can emit a diffuse water jet 240 forceful (i.e., sufficient force to remove the coke bed collapse 28) within only about 8 feet (about 2.4 meters) of the self-clearing nozzles 140, such as for example, from about 3 feet (about 0.9 meters) to about 5 feet (about 1.5 meters).

Referring again to FIG. 1, in one embodiment of the decoking tool 10, the tool body 100 may comprise a fluid inlet 102 in fluid communication with a fluid source 12. The fluid inlet 102 of the tool body 100 may be in fluid communication with the rotatable diverter plate 110. The rotatable diverter plate 110 may be in fluid communication with the diverter body 120. The clearing flow paths 104 may begin at the clearing orifices 124 of the diverter body 120 and travels through the tool body 100 to the self-clearing nozzles 140. The self-clearing nozzles 140 can be coupled to the tool body 100 at the end of the clearing flow paths 104. The shifting apparatus 134 is operatively coupled to the rotatable diverter plate 110 such that the rotatable diverter plate 110 can be rotated automatically by reducing the pressure of the pressurized fluid to a pressure less than the shift arming pressure after the shifting apparatus is armed. Accordingly, the self-clearing nozzles 140 may be activated by setting the pressure of the pressurized fluid to a pressure greater than or equal to the cutting pressure.

Referring next to FIG. 1 in conjunction with FIG. 7A, the decoking tool 10 may further comprise boring nozzles 180 for boring a pilot hole in a coke drum 20. The boring nozzles 180 can be coupled to the tool body 100 at the end of boring flow paths 108. The boring flow paths 108 can begin at the boring orifices 128 (FIG. 3) of the diverter body 120 and travel through the tool body 100. Each boring nozzle 180 can be directed substantially downwards (depicted as the negative Y-direction along the Y-axis in FIG. 1). For example, the boring nozzles 180 may be directed substantially downwards such that they are aligned within about 30° (about 0.52 radians) of the Y-axis such as, for example, within about 15° (about 0.26 radians) of the Y-axis.

Referring next to FIG. 1 in conjunction with FIG. 7B, the decoking tool 10 may comprise cutting nozzles 160 for removing coke 26 from coke drum 20. The cutting nozzles 160 can be coupled to the tool body 100 at the end of cutting flow paths 106. The cutting flow paths 106 can begin at the cutting orifices 126 of the diverter body 120. The cutting nozzles 160 are directed substantially sideways (depicted as the positive or negative X-direction along the X-axis in FIG. 1). For example, the cutting nozzles 160 may be directed substantially sideways such that they are aligned within about 30° (about 0.52 radians) of the X-axis such as, for example, within about 15° (about 0.26 radians) of the X-axis.

In one embodiment, depicted in FIGS. 1 and 4A, the self-clearing nozzles 140 may be sealed with a burst disc 142 to allow the clearing flow paths 104 to be pressurized to the arming pressure without water flowing through the self-clearing nozzles 140. The shifting apparatus 134, the rotatable diverter plate 110, the diverter body 120 and the burst disc 142 allows the self-clearing nozzles 140 to be selectively activated. Thus, the self-clearing nozzles 140 may be activated only when a fluid bed collapse occurs, by for example directing pressurized water into the clearing flow path 104 (FIG. 1) at a desired pressure that is greater than the burst pressure of the burst disc 142 (e.g., about 5,000 psi (about 34,473 kPa) for a burstdisc rated at about 3,000 psi (about 20,684 kPa)). The self-clearing nozzles 140 may be by-passed by, for example, arming the shifting apparatus 134 and instead of increasing the pressure to the cutting pressure, decreasing the pressure from the arming pressure to cause the shifting apparatus 134 to automatically rotate the rotatable diverter plate 110. Specifically, the shifting apparatus 134 causes the clearing flow paths 104 to transition from being aligned with the selection orifices 112 of the rotatable diverter plate 110 to being aligned with the blocking portion 114 of the rotatable diverter plate 110. Accordingly, the cutting pressure may be greater than the shift arming pressure. For example, the cutting pressure may be from about 4,000 psi (about 27,579 kPa) to about 6,000 psi (about 41,369 kPa) such as about 5,000 psi (about 34,474 kPa). The shift arming pressure may be from about 1,000 psi (about 6,894 kPa) to about 3,000 psi (about 20,684 kPa) such as about 2,500 psi (about 17,237 kPa). Furthermore, it is noted that the burst disc 142 may be rated, i.e., configured to burst, at any pressure that is less than the cutting pressure and greater than the shift arming pressure. Accordingly, the burst disc 142 may be replaced after each use of self-clearing nozzles 140.

Referring collectively to FIGS. 1 and 4B, the self-clearing nozzle 140 may be coupled to a resilient cap 200 to protect the burst disc 142 from falling coke. The resilient cap 200 may be removably attached to the self-clearing nozzle 140 such that the cutting pressure is sufficient to remove the resilient cap 200 from the self-clearing nozzle 140 after the burst disc 142 has been destroyed. In one embodiment, the resilient cap 200 is frictionally coupled to the self-clearing nozzle 140. It is noted that, while the resilient cap 200 is depicted in FIG. 4B as comprising a domed shaped portion 202, the resilient cap 200 may be any shape suitable to protect the burst disc 142. Furthermore, it is noted that, the resilient cap 200 may be replaced after each use of self-clearing nozzles 140.

Referring again to FIG. 1, the decoking tool 10 may comprise pressure regulating nozzles 136 for releasing pressurized fluid from the clearing flow paths 104 and mitigating the buildup of pressure within the clearing flow paths 104 while the burst discs 142 seal the clearing flow paths 104. The pressure regulating nozzles 136 can be coupled to the tool body 100 along the clearing flow paths 104 such that each pressure regulating nozzle 136 is in fluid communication with at least one of the clearing flow paths 104. Specifically, a pressure regulating nozzle 136 may be disposed between the clearing orifice 124 of the diverter body 120 and the self-clearing nozzle 140. The pressure regulating nozzles 136 may be directed substantially sideways and when supplied fluid pressurized to the shift arming pressure, direct a jet of fluid towards the walls of a coking drum to release pressure acting upon the burst disc 142. While the pressure regulating nozzles 136 may be effective for removing coke, the pressure regulating nozzles 136 are configured to operate at pressures below the cutting pressure. Specifically, the cutting pressure is typically larger than the shift arming pressure (e.g., about 5,000 psi (about 34,474 kPa) and about 2,500 psi (about 17,237 kPa), respectively). Thus, the pressure regulating nozzles 136 can be configured to be substantially bypassed when cutting pressure is applied to the clearing flow paths 104. For example, the self-clearing nozzles 140 may be deactivated by the burst disc 142 and pressure build up may be mitigated by the pressure regulating nozzles 136 when the clearing flow paths 104 are supplied with water at the shift arming pressure. The self-clearing nozzles 140 may be activated by bursting the burst disc 142 and overwhelming the pressure regulating nozzles 136 when the clearing flow paths 104 are supplied with water at the cutting pressure.

Figure 5:
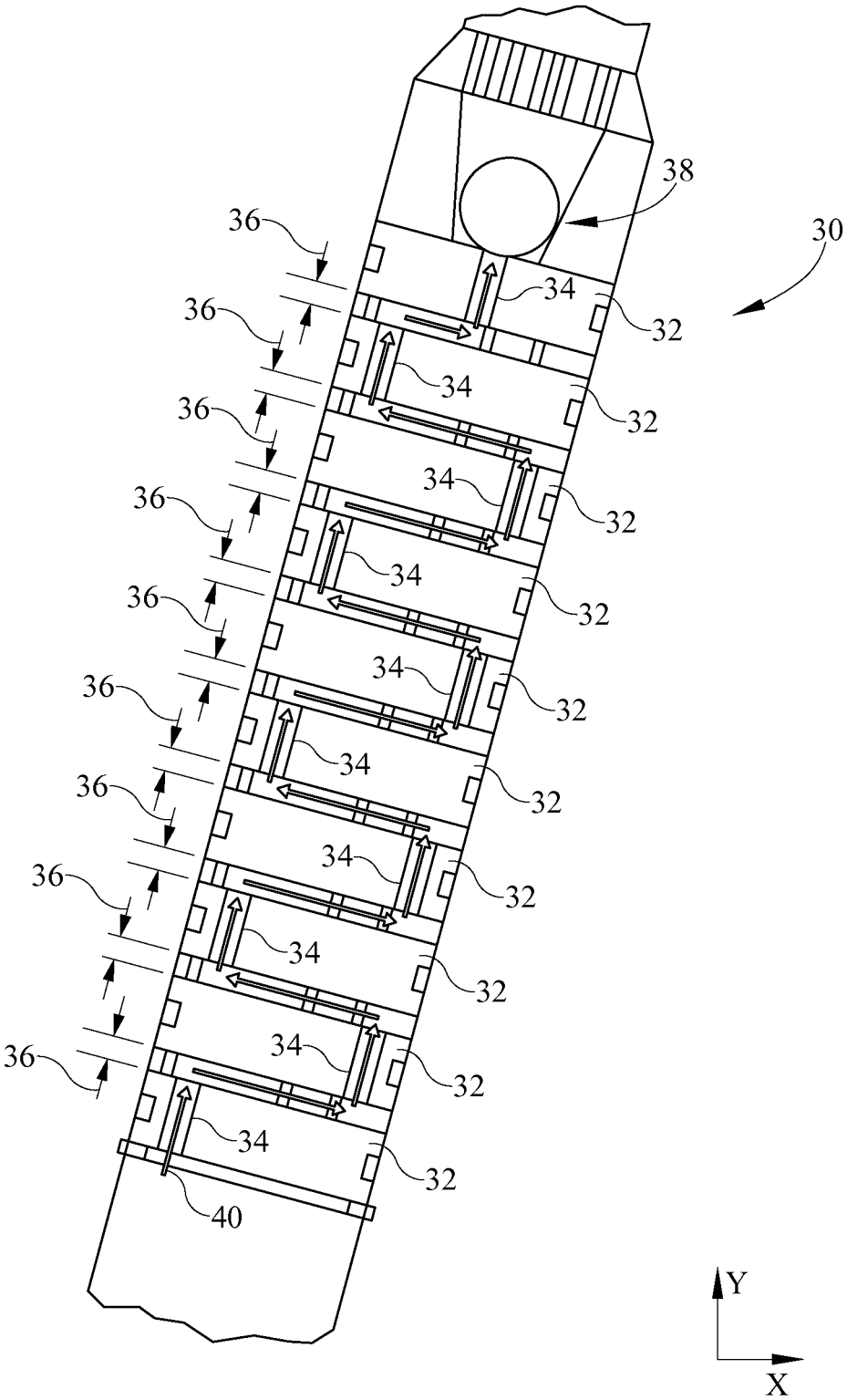
FIG. 5 schematically depicts a flow modification device according to one or more embodiments shown and described herein.
Figure 6:
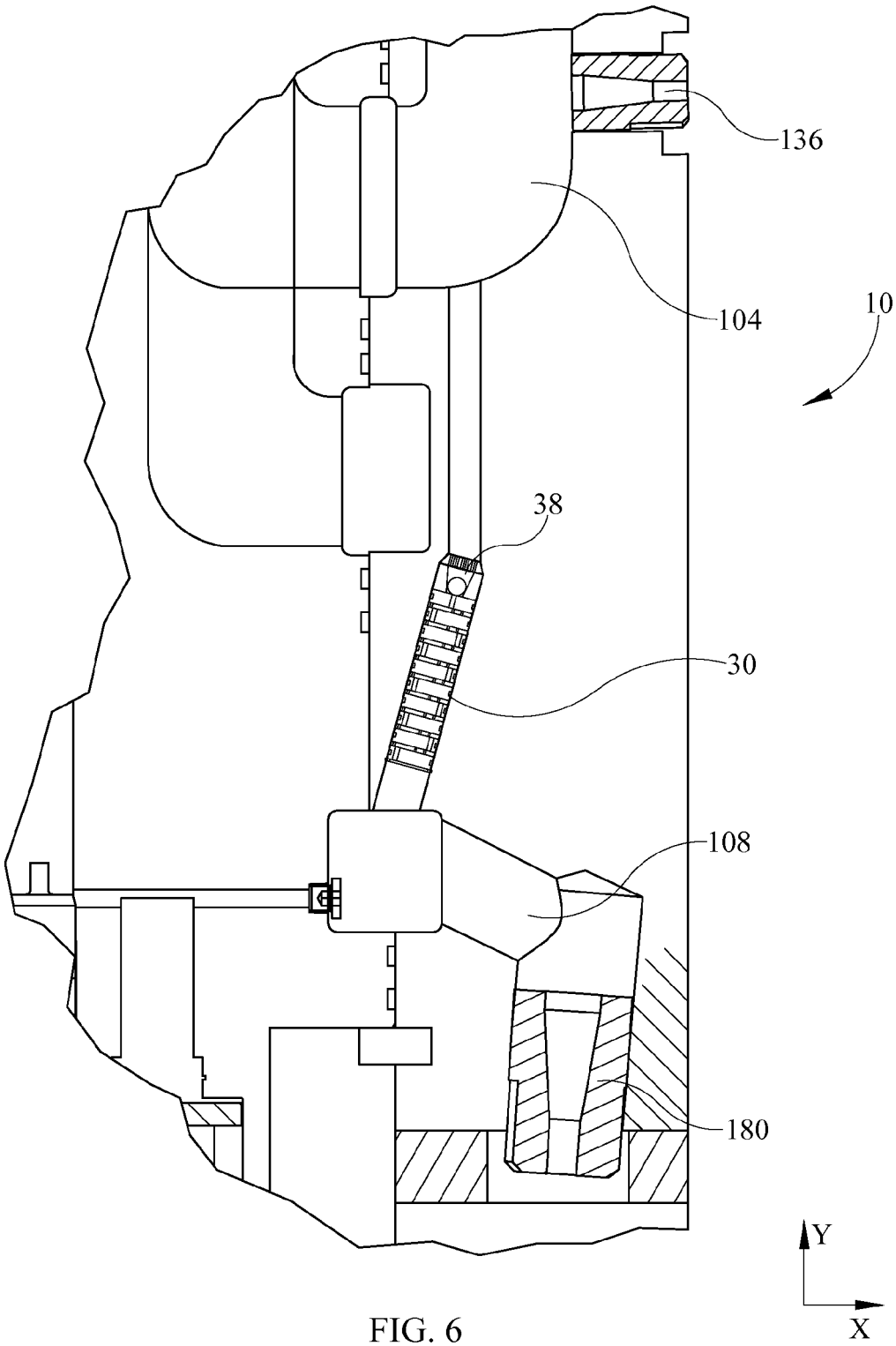
FIG. 6 schematically depicts a cross-sectional view of the placement of the flow modification device of FIG. 5 according to one or more embodiments shown and described herein.

Referring collectively to FIGS. 1 and 5-6, the decoking tool 10 may comprise a flow modification device 30 that allows for a secondary flow of fluid from one flow path of the decoking tool 10 to another flow path of the decoking tool 10 to traverse a tortuous flow path. As depicted in FIG. 5, the flow modification device 30 may comprise a plurality of plates 32 each having a fluid orifice 34. Each of the plates 32 may be spaced apart from one another by a fluid flow gap 36, which allows fluid to flow between the plates 32 of the flow modification device 30 that are adjacent to one another. The plates 32 may be aligned such that the fluid orifices 34 of adjacent plates 32 are skewed with respect to one another. The plates 32 and the fluid orifices 34 constrain the fluid such that fluid can flow between the plates 32 and through the fluid orifices 34. Accordingly, fluid flowing along the flow direction 40 is turned one or more times, which may result in a drop in fluid pressure. The tortuous flow path formed by the flow modification device 30 may further comprise a one way valve 38 which allows fluid to flow only along the flow direction 40 (also denoted by the arrows in FIG. 5). It is noted that, while the one way valve 38 is depicted in FIG. 5 as a ball check valve, any type of one way valve 38 may be utilized.

Referring to FIG. 6, the decoking tool 10 may comprise a flow modification device 30 in fluid communication with the boring flow path 108 and the clearing flow path 104. The flow modification device 30 may be unidirectional such that when the pressurized fluid is disposed in the boring flow path 108, a portion of the pressurized fluid flows through the tortuous flow path of the flow modification device 30 to the clearing flow path 104. When the pressurized fluid is disposed in the clearing flow path 104 the pressurized fluid may be blocked from flowing through the flow modification device 30 to boring flow path 108.

Referring again to FIG. 1, the flow modification device 30 may also be used to establish a tortuous flow path between the boring flow path 108 and the cutting flow path 106. The tortuous flow path may be unidirectional such that when the pressurized fluid is disposed in the boring flow path 108, a portion of the pressurized fluid flows through the flow modification device 30 to the cutting flow path 106. When the pressurized fluid is disposed in the cutting flow path 106 the pressurized fluid can be blocked from flowing through the flow modification device 30 to boring flow path 108. According to the embodiments described herein, when the boring flow path 108 is supplied with water at the cutting pressure, a relative small amount of the pressurized water may be diverted to the cutting nozzles 160 and/or the pressure regulating nozzles 136 to avoid clogging the cutting nozzles 160 and/or the pressure regulating nozzles 136 while the boring nozzles 180 are actively removing coke. Furthermore, the clearing flow paths 104 and/or the cutting flow paths 106 may be prevented from losing pressure via the tortuous flow path of flow modification device 30, i.e., the one way valve 38 may prevent any secondary flow from traveling through the flow modification device 30.

Referring collectively to FIGS. 1 and 5-6, the decoking tool 10 may comprise two flow modification devices 30. One of the flow modification devices 30 may allow the one way flow of fluid from the boring flow path 108 to the clearing flow path 104. The second of the flow modification devices 30 may allow the one way flow of fluid from the boring flow path 108 to the cutting flow path 106. The cutting nozzles 160 and the pressure regulating nozzles 136 may be pressurized via the flow modification devices 30 while the boring nozzles 180 are activated. Accordingly, the cutting nozzles 160 and the pressure regulating nozzles 136 may be protected from becoming clogged while the boring nozzles 180 are activated. For example, a low pressure stream may flow through the flow modification devices 30 into the clearing flow paths 104 and the cutting flow paths 106. When the cutting nozzles 160 and/or the pressure regulating nozzles 136 are free of coke, the low pressure fluid may flow through the nozzles. When the cutting nozzles 160 and/or the pressure regulating nozzles 136 are clogged by coke, the low pressure fluid may cause the pressure to build up behind the clog. The pressure may continue to build until the clog is removed. Moreover, because of the one way flow, the pressure available to the cutting nozzles 160, while the cutting nozzles 160 are activated, is not reduced by the flow modification devices 30.

Referring collectively to FIGS. 7A to 7C a decoking system 14 may comprise a labyrinth guide plate 210 and a decoking tool 10, as described herein. The labyrinth guide plate 210 may comprise a first plate 212 having a first fluid blocking potion 216 and a first vapor release orifice 218 and a second plate 214 having a second fluid blocking potion 220 and a second vapor release orifice 222. The first plate 212 and the second plate 214 may be offset by a vapor release gap 224 such that the first vapor release orifice 218 of the first plate 212 is skewed with respect to the second vapor release orifice 222 of the second plate 214. Moreover, the first fluid blocking potion 216 of the first plate 212 may overlap the second fluid blocking potion 220 of the second plate 214 with respect to the X-direction. Accordingly, the labyrinth guide plate 210 may be coupled to top drum flange 22 of the coke drum 20 to mitigate the flow of the water out of the coke drum 20. Specifically, any water that is directed vertically (i.e., having a velocity component in the positive Y-direction) may be blocked by the labyrinth guide plate 210, while gas vapor may exit the coke drum 20 via the path formed by the first vapor release orifice 218, the second vapor release orifice 222 and the vapor release gap 224.

It should now be understood that, the decoking tool 10 can be utilized to remove coke 26 from a coke drum 20. The decoking tool 10 may be suspended from a fluid source 12 that is fed through the labyrinth guide plate 210 and lowered until a path is cut to the bottom outlet 24 of the coke drum 20. The removal of the coke 26 may be performed in three different phases. In the first phase, depicted in FIG. 7A, the decoking tool 10 may be lowered into a coke drum 20 from the top drum flange 22 towards the bottom outlet 24 of the coke drum 20. For example, the boring nozzles 180 may be supplied with water at the cutting pressure and emit a water jet 280 downwards to loosen the coke 26 from the coke drum 20 and allow the removed coke to flow out of the coke drum 20, i.e., drain out of the bottom outlet 24 of the coke drum 20.

In the second phase, depicted in FIG. 7B, the decoking tool 10 may be shifted by the shifting apparatus 134 (FIG. 1), such that fluid may be supplied to the cutting nozzles 160. Once the cutting nozzles are activated, the decoking tool 10 may be raised from the bottom outlet 24 of the coke drum 20 towards the top drum flange 22 of the coke drum 20 to remove the coke 26 remaining in the coke drum 20. For example, the cutting nozzles 160 may be supplied with water at the cutting pressure and emit a water jet 260 towards the walls of a coke drum 20 to loosen the coke 26 from the coke drum 20 and allow the removed coke to flow out of the coke drum 20, i.e., drain out of the bottom outlet 24 of the coke drum 20.

In the optional third phase, depicted in FIG. 7C, which preferably is activated only when the decoking tool 10 is trapped by a coke bed collapse 28, the self-clearing nozzles 140 may be activated by shifting the shifting apparatus 134 (FIG. 1) and bursting the burst discs 142 (FIG. 1). For example, the self-clearing nozzles 140 may be supplied with water at the cutting pressure and emit a diffuse water jet 240 to clear the coke bed collapse 28 and allow the decoking tool 10 to be extricated. Accordingly, because the self-clearing nozzles are built into the tool body 100, the decoking tool 10 may be extricated without the need for additional tools.

Referring collectively to FIGS. 7A to 7C, the diffuse water jet 240 emitted by the self-clearing nozzles 140 when supplied with water at the cutting pressure may be less cohesive than the water jet 260 emitted by the cutting nozzles 160 when supplied with water at the cutting pressure or the water jet 280 emitted by the boring nozzles 180 when supplied with water at the cutting pressure. Specifically, the diffuse water jet 240 with less cohesion exhibits a wider spray pattern per unit of length away from the self-clearing nozzles 140 than the water jet 260 with respect to the cutting nozzles 160 or the water jet 280 with respect to the boring nozzles 180.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Furthermore, it is noted that directional references such as, for example, upwards, downwards, sideways, and the like have been provided for clarity and without limitation. Specifically, it is noted such directional references are made with respect to the coordinate system depicted in FIGS. 1-7C. Thus, the directions may be reversed or oriented in any direction by making corresponding changes to the provided coordinate system with respect to the structure to extend the examples described herein.

While particular embodiments and aspects of the present disclosure have been illustrated and described herein, various other changes and modifications may be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A decoking tool comprising:

a tool body comprising a fluid inlet for receiving a pressurized fluid;

a diverter plate in fluid communication with the fluid inlet, the diverter plate defining at least one selection orifice disposed therethrough;

a diverter body in fluid communication with the diverter plate through the at least one selection orifice, the diverter body defining therein at least one clearing orifice, at least one cutting orifice and at least one boring orifice;

a plurality of flow paths comprising a clearing flow path, a cutting flow path and a boring flow path each of which terminates in a nozzle that is placed in selective fluid communication with the pressurized fluid through the diverter plate and the respective orifice in the diverter body, wherein the nozzle that terminates the clearing flow path is directed substantially upwards during normal operation of the decoking tool;

a pressure regulating nozzle disposed within the tool body and in fluid communication with the clearing flow path such that excess pressure that builds up within the clearing flow path is conveyed through the pressure regulating nozzle to a location outside of the tool body; and a shifting apparatus operatively coupled to at least one of the diverter plate and the diverter body such that upon operation of the shifting apparatus, the diverter plate and the diverter body rotate relative to one another to substantially align the at least one selection orifice and at least one of the at least one clearing orifice, the at least one cutting orifice and the at least one boring orifice in order to establish fluid communication between the fluid inlet and the respective nozzle.

2. The decoking tool of claim 1, wherein the nozzle that terminates the clearing flow path is configured such that when a pressure of the pressurized fluid is greater than or equal to a shift arming pressure and less than a cutting pressure, the nozzle that terminates the clearing flow path is deactivated, and when the pressure of the pressurized fluid is greater than or equal to the cutting pressure, the nozzle that terminates the clearing flow path is activated.

3. The decoking tool of claim 2 further comprising a burst disc coupled to the nozzle that terminates the clearing flow path, wherein the burst disc blocks the nozzle that terminates the clearing flow path.

4. The decoking tool of claim 3 wherein the burst disc is configured to burst at about 3,000 psi and the cutting pressure is about 5,000 psi.

5. The decoking tool of claim 3 further comprising a resilient cap frictionally coupled to the nozzle that terminates the clearing flow path, wherein the resilient cap blocks the nozzle that terminates the clearing flow path until such time as the burst disc bursts and the pressurized fluid removes the resilient cap from the nozzle that terminates the clearing flow path.

6. The decoking tool of claim 5 wherein the resilient cap comprises a domed shaped portion.

7. The decoking tool of claim 1, wherein the nozzle that corresponds to the boring flow path is directed substantially downwards and the nozzle that corresponds to the cutting flow path is directed substantially sideways.

8. The decoking tool of claim 7 further comprising a flow modification device that is in fluid communication with the boring flow path and the clearing flow path to produce a tortuous path through which the pressurized fluid may flow, wherein the flow modification device is unidirectional such that when the pressurized fluid is disposed in the boring flow path a portion of the pressurized fluid flows through the flow modification device to the clearing flow path, and when the pressurized fluid is disposed in the clearing flow path the pressurized fluid is blocked from flowing through the flow modification device to the boring flow path such that the pressure of the pressurized fluid disposed in the clearing flow path is not reduced by the flow modification device.

9. The decoking tool of claim 8 wherein:

the flow modification device comprises a first plate and a second plate;

the first plate comprises a first fluid orifice;

the second plate comprises a second fluid orifice; and the first plate and the second plate are offset by a fluid flow gap, wherein the first fluid orifice is skewed with respect to the second fluid orifice.

10. The decoking tool of claim 7 further comprising a flow modification device that is in fluid communication with the boring flow path and the cutting flow path to produce a tortuous path through which the pressurized fluid may flow, wherein the flow modification device is unidirectional such that when the pressurized fluid is disposed in the boring flow path a portion of the pressurized fluid flows through the flow modification device to the cutting flow path, and when the pressurized fluid is disposed in the cutting flow path the pressurized fluid is blocked from flowing through the flow modification device to the boring flow path such that the pressure of the pressurized fluid disposed in the cutting flow path is not reduced by the flow modification device.

11. The decoking tool of claim 7 wherein:

the pressurized fluid is water;

when a pressure of the pressurized fluid is at a cutting pressure and the pressurized fluid flows through the clearing flow path, the nozzle that terminates the clearing flow path emits a diffuse water jet;

when the pressure of the pressurized fluid is at the cutting pressure and the pressurized fluid flows through the cutting flow path, the nozzle that corresponds to the cutting flow path emits a water jet; and the diffuse water jet produced is less cohesive than the water jet.

12. The decoking tool of claim 7 wherein:

the pressurized fluid is water;

when a pressure of the pressurized fluid is at a cutting pressure and the pressurized fluid flows through the clearing flow path, the nozzle that terminates the clearing flow path emits a diffuse water jet; and the diffuse water jet is most forceful from about 3 feet to about 5 feet from the nozzle that terminates the clearing flow path.

13. The decoking tool of claim 1 wherein the shifting apparatus is armed when a pressure of the pressurized fluid is greater than or equal to a shift arming pressure, such that the shifting apparatus automatically rotates the diverter plate and aligns the at least one selection orifice of the diverter plate to the at least one cutting orifice or the at least one boring orifice of the diverter body when the pressure of the pressurized fluid is reduced after the shifting apparatus is armed.

14. A decoking system comprising a labyrinth guide plate and a decoking tool, wherein:

the labyrinth guide plate comprises a first plate and a second plate;

the first plate comprises a first fluid blocking potion and a first vapor release orifice;

the second plate comprises a second fluid blocking potion and a second vapor release orifice;

the first plate and the second plate are offset by a vapor release gap, wherein the first vapor release orifice skewed with respect to the second vapor release orifice;

the decoking tool operates within a coke drum and below the labyrinth guide plate and comprises a tool body, a diverter plate, a diverter body, a plurality of flow paths and a shifting apparatus;

the tool body comprises a fluid inlet for receiving a pressurized fluid;

the diverter plate is in fluid communication with the fluid inlet, the diverter plate defining at least one selection orifice disposed therethrough;

the diverter body is in fluid communication with the diverter plate through the at least one selection orifice, the diverter body defining therein at least one clearing orifice, at least one cutting orifice and at least one boring orifice;

the plurality of flow paths comprise a clearing flow path, a cutting flow path and a boring flow path each of which terminates in a nozzle that is placed in selective fluid communication with the pressurized fluid through the diverter plate and the respective orifice in the diverter body, wherein the nozzle that terminates the clearing flow path is directed substantially upwards during normal operation of the decoking tool; and the shifting apparatus is operatively coupled to at least one of the diverter plate and the diverter body such that upon operation of the shifting apparatus, the diverter plate and the diverter body rotate relative to one another to substantially align the at least one selection orifice and at least one of the at least one clearing the orifice, the at least one cutting orifice and the at least one boring orifice in order to establish fluid communication between the fluid inlet and the respective nozzle.

15. The decoking system of claim 14 wherein the decoking tool further comprises a pressure regulating nozzle in fluid communication with the clearing flow path and disposed between the at least one clearing orifice and the nozzle that terminates the clearing flow path.

16. The decoking system of claim 14 wherein the decoking tool further comprises a burst disc coupled to the nozzle that terminates the clearing flow path, wherein the burst disc blocks the nozzle that terminates the clearing flow path.

17. The decoking system of claim 14 wherein:

the nozzle that terminates the clearing flow path is configured such that when a pressure of the pressurized fluid is greater than or equal to a shift arming pressure and less than a cutting pressure, the nozzle that terminates the clearing flow path is deactivated, and when the pressure of the pressurized fluid is greater than or equal to the cutting pressure, the nozzle that terminates the clearing flow path is activated; and the cutting pressure is greater than about 1.5 times the shift arming pressure.

18. The decoking system of claim 14 wherein the decoking tool further comprises a resilient cap frictionally coupled to the nozzle that terminates the clearing flow path, wherein the resilient cap blocks the nozzle that terminates the clearing flow path.

* * * * *

UNITED STATES PATENT AND TRADEMARK OFFICE

CERTIFICATE OF CORRECTION

PATENT NO. : 8,770,494 B2
APPLICATION NO. : 13/217357
DATED : July 8, 2014
INVENTOR(S) : Daniel O. Arzuaga It is certified that error appears in the above-identified patent and that said Letters Patent is hereby corrected as shown below:

In the Specification

Col. 3, Lines 37-38,
"orifice and at least one of the at least one clearing the orifice, the at least one cutting orifice and the at least one boring" should read
--orifice and at least one of the clearing orifice, cutting orifice and boring--;

Col. 3, Line 67,
"selection orifice and at least one of the at least one clearing" should read
--selection orifice and at least one of the clearing--;

Col. 4, Lines 1-2,
"orifice, the at least one cutting orifice and the at least one" should read
--orifice, cutting orifice and--;

Col. 4, Line 20,
"drawings" should read
--drawings.--;

Col. 5, Line 56,
"of the a rotatable diverter plate 110 and the diverter body 120" should read
--of the rotatable diverter plate 110 and the diverter body 120--; and Col. 8, Line 3,
"a burstdisc rated at about 3,000 psi (about 20,684 kPa)). The" should read
--a burst disc rated at about 3,000 psi (about 20,684 kPa)). The--.

Signed and Sealed this
Twenty-fourth Day of March, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,770,494 B2
APPLICATION NO. : 13/217357
DATED : July 8, 2014
INVENTOR(S) : Daniel O. Arzuaga It is certified that error appears in the above-identified patent and that said Letters Patent is hereby corrected as shown below:

In the Specification

Col. 3, Lines 37-38,
"orifice and at least one of the at least one clearing the orifice, the at least one cutting orifice and the at least one boring" should read
--orifice and at least one of the clearing orifice, cutting orifice and boring--;

Col. 3, Line 67,
"selection orifice and at least one of the at least one clearing" should read
--selection orifice and at least one of the clearing--;

Col. 4, Line 1,
"orifice, the at least one cutting orifice and the at least one" should read
--orifice, cutting orifice and--;

Col. 4, Line 20,
"drawings" should read
--drawings.--;

Col. 5, Line 56,
"of the a rotatable diverter plate 110 and the diverter body 120" should read
--of the rotatable diverter plate 110 and the diverter body 120--; and Col. 8, Line 3,
"a burstdisc rated at about 3,000 psi (about 20,684 kPa)). The" should read
--a burst disc rated at about 3,000 psi (about 20,684 kPa)). The--.

This certificate supersedes the Certificate of Correction issued March 24, 2015.

Signed and Sealed this
Fourteenth Day of July, 2015

Michelle K. Lee

Michelle K. Lee
*Director of the United States Patent and Trademark Office*